US010865595B2

(12) United States Patent
Coleman

(10) Patent No.: US 10,865,595 B2
(45) Date of Patent: Dec. 15, 2020

(54) DOOR CLOSER WITH HOLD-OPEN AND RELEASE

(71) Applicant: Schlage Lock Company LLC, Carmel, IN (US)

(72) Inventor: Michael D. Coleman, Noblesville, IN (US)

(73) Assignee: Schlage Lock Company LLC, Carmel, IN (US)

( * ) Notice: Subject to any disclaimer, the term of this patent is extended or adjusted under 35 U.S.C. 154(b) by 119 days.

(21) Appl. No.: 16/221,769

(22) Filed: Dec. 17, 2018

(65) Prior Publication Data

US 2020/0190885 A1 Jun. 18, 2020

(51) Int. Cl.
*E05F 3/22* (2006.01)
*E05F 1/10* (2006.01)

(52) U.S. Cl.
CPC ..... *E05F 3/222* (2013.01); *E05F 1/10* (2013.01); *E05F 3/22* (2013.01)

(58) Field of Classification Search
CPC ..... E05F 3/22; E05F 1/10; E05F 1/006; E05F 15/72; E05F 3/221; E05F 3/222; E05C 17/003; Y10T 16/22
USPC ..... 49/31
See application file for complete search history.

(56) References Cited

U.S. PATENT DOCUMENTS 509,116 A * 11/1893 Callahan ..... 49/379
3,685,567 A * 8/1972 Pemberton ..... E05D 13/1261 160/8
3,699,608 A * 10/1972 Schwarz ..... E05F 17/00 16/79
3,777,423 A * 12/1973 Coulter ..... E05F 3/222 49/31
3,905,063 A * 9/1975 Coulter ..... E05F 3/222 16/48.5

(Continued)

FOREIGN PATENT DOCUMENTS

GB 2507582 A 5/2014
WO 2007057672 A2 5/2007

(Continued)

OTHER PUBLICATIONS

Daniel P.W. Ellis; Detecting Alarm Sounds; Department of Electrical Engineering, Columbia University, New York, New York; dpwe@ee.columbia.edu; 4 pages.

*Primary Examiner* — Jeffrey O'Brien
(74) *Attorney, Agent, or Firm* — Taft Stettinius & Hollister LLP

(57) ABSTRACT

Certain embodiments relate to a hold-open assembly for a door closer including a pinion operable to rotate in a closing direction and an opposite opening direction. The hold-open assembly includes a ratchet wheel, a pawl, a controller, and a driver. The ratchet wheel is structured to be mounted to the pinion for joint rotation therewith. The pawl has an engaged position in which the pawl prevents rotation of the ratchet wheel in the closing direction, and has a disengaged position in which the pawl permits rotation of the ratchet wheel in both the opening direction and the closing direction. The controller is operable to determine a release condition and is configured to transmit a release signal in response to determining the release condition. The driver is configured to move the pawl from the engaged position to the disengaged position in response to the release signal.

25 Claims, 6 Drawing Sheets

(56) References Cited

U.S. PATENT DOCUMENTS 3,908,309 A * 9/1975 Coulter ..... E05F 3/222 49/31
4,378,612 A * 4/1983 Beers ..... E05F 3/12 16/49
5,333,355 A * 8/1994 Beswick ..... E05F 1/123 16/300
5,482,103 A * 1/1996 Burgess ..... A62C 2/242 160/190
5,495,639 A * 3/1996 Wartian ..... E05F 1/1016 16/79
5,525,963 A * 6/1996 Purssey ..... A62C 2/24 292/92
5,937,478 A * 8/1999 Regnier ..... E05F 1/16 16/77
6,978,516 B1 * 12/2005 Calderon ..... E05C 17/16 16/229
7,134,168 B1 * 11/2006 Qing ..... E05F 3/221 16/80
7,448,426 B2 * 11/2008 Hsieh ..... E06B 9/82 160/310
7,574,826 B2 * 8/2009 Evans ..... E05F 15/668 49/13
7,610,719 B2 * 11/2009 Hsieh ..... E05F 1/006 160/1
7,670,216 B2 * 3/2010 Chilelli ..... E05F 3/22 454/195
8,169,169 B2 5/2012 Hass et al.
8,225,458 B1 * 7/2012 Hoffberg ..... E05F 3/222 16/49
8,564,235 B2 * 10/2013 Burris ..... E05F 3/22 318/466
8,905,113 B2 * 12/2014 Daus ..... E06B 5/16 160/9
9,045,927 B1 * 6/2015 Hoffberg ..... E05F 15/73
9,328,547 B2 * 5/2016 Daus ..... F16H 1/28
9,399,884 B2 * 7/2016 Copeland, II ..... G05B 15/02
9,536,400 B2 1/2017 Asada
9,822,570 B2 * 11/2017 Jaranson ..... E05F 15/70
9,995,076 B1 * 6/2018 Hoffberg ..... E05F 3/10
10,030,426 B2 * 7/2018 Langenberg ..... E05F 3/224
10,641,026 B2 * 5/2020 Qiu ..... E05F 3/22
2013/0091768 A1 4/2013 Houser et al.
2014/0352112 A1 * 12/2014 Somemiya ..... H04N 1/00493 16/343
2017/0292311 A1 10/2017 Podkopayev
2018/0305969 A1 * 10/2018 Docksteader ..... E05F 1/12
2020/0224482 A1 * 7/2020 Sellinger ..... E05F 15/72

FOREIGN PATENT DOCUMENTS

WO 2010128314 A2 11/2010
WO 2015180769 A1 12/2015
WO 2017191449 A1 11/2017

* cited by examiner

DOOR CLOSER WITH HOLD-OPEN AND RELEASE

TECHNICAL FIELD

The present disclosure generally relates to door closers, and more particularly but not exclusively relates to door closers configured for use with fire doors.

BACKGROUND

Door closers are frequently used to bias an associated door toward a closed position with respect to a doorframe in which the door is mounted. In certain applications, such as when the door is installed to a corridor, it is often desired for the door to remain open under normal circumstances. However, fire codes and other regulations often mandate that doors return to the closed position in the event of emergency situations. For example, fire doors are typically required to return to the closed position in the event of fires.

To accommodate these competing concerns, certain installations utilize a door closer in combination with an electromagnet that holds the door open against the biasing force of the closer. In emergency situations, the power to the electromagnet is cut, and the closer returns the door to the closed position. While certain existing closers include hold-open features that retain the door in the open position, these closers typically require connection to line power and/or an access control system to ensure that the hold-open feature is released in the event of a fire.

As should be evident from the foregoing, certain existing approaches for providing hold-open and selective release require that the closer and/or an electromagnet be hardwired to line power and/or an access control system. This can result in significant costs, as an electrician typically must route power to the opening and/or communication lines to the centralized fire alarm system. This is particularly true in retrofit situations, in which power lines may not necessarily be readily available in the vicinity of the opening. For these reasons among others, there remains a need for further improvements in this technological field.

SUMMARY

Certain embodiments of the present application relate to a hold-open assembly for a door closer including a pinion operable to rotate in a closing direction and an opposite opening direction. The hold-open assembly includes a ratchet wheel, a pawl, a controller, and a driver. The ratchet wheel is structured to be mounted to the pinion for joint rotation therewith. The pawl has an engaged position in which the pawl prevents rotation of the ratchet wheel in the closing direction, and has a disengaged position in which the pawl permits rotation of the ratchet wheel in both the opening direction and the closing direction. The controller is operable to determine a release condition and is configured to transmit a release signal in response to determining the release condition. The driver is configured to move the pawl from the engaged position to the disengaged position in response to the release signal. Further embodiments, forms, features, and aspects of the present application shall become apparent from the description and figures provided herewith.

DETAILED DESCRIPTION OF ILLUSTRATIVE EMBODIMENTS

Figure 1:
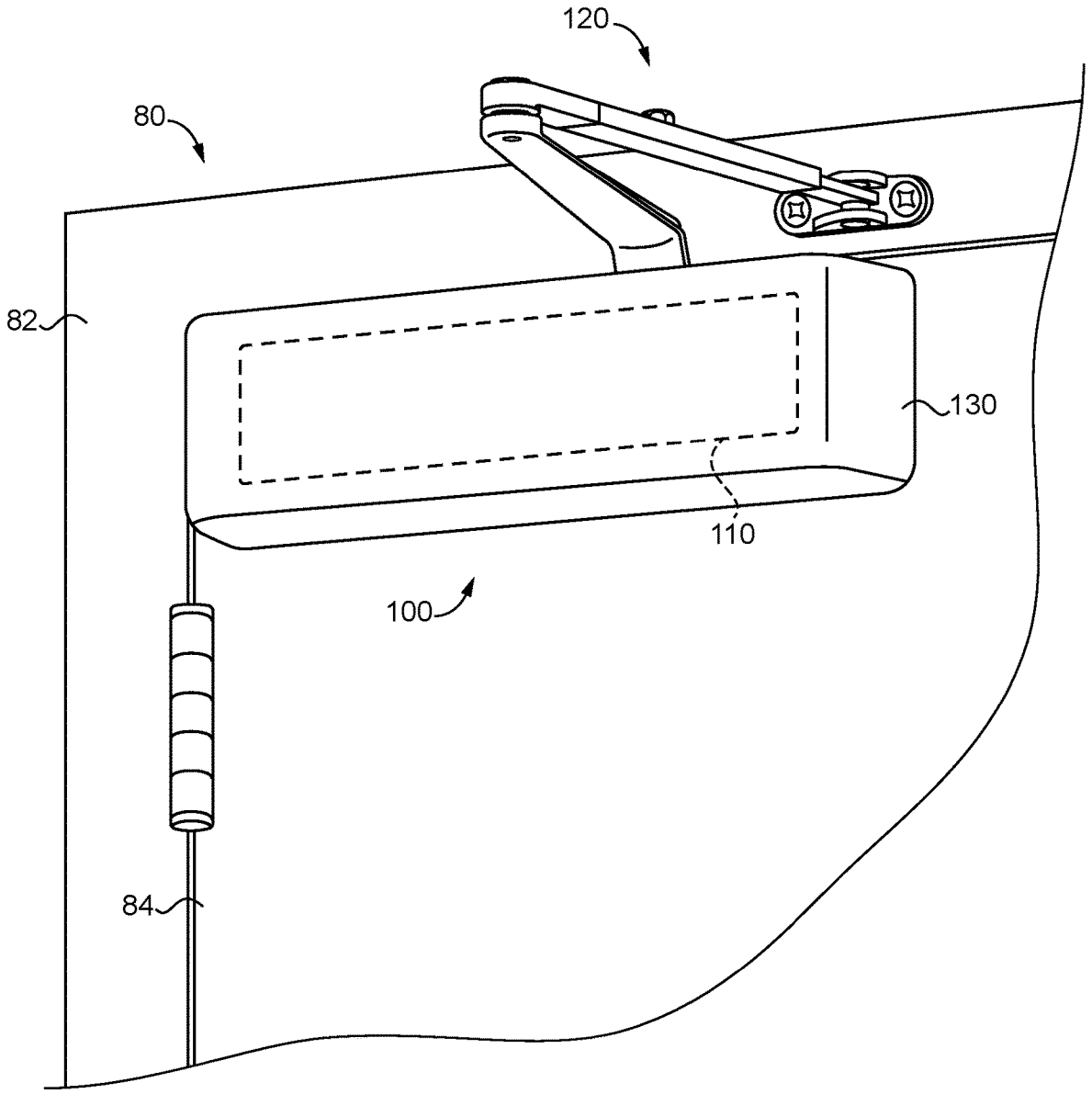
FIG. 1 is a perspective illustration of a closure assembly including a door closer according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

With reference to FIG. 1, illustrated therein is a closure assembly 80 according to certain embodiments. The closure assembly 80 includes a doorframe 82, a door 84 pivotably mounted to the doorframe 82, and a door closer 100 connected between the doorframe 82 and the door 84.

Figure 2:
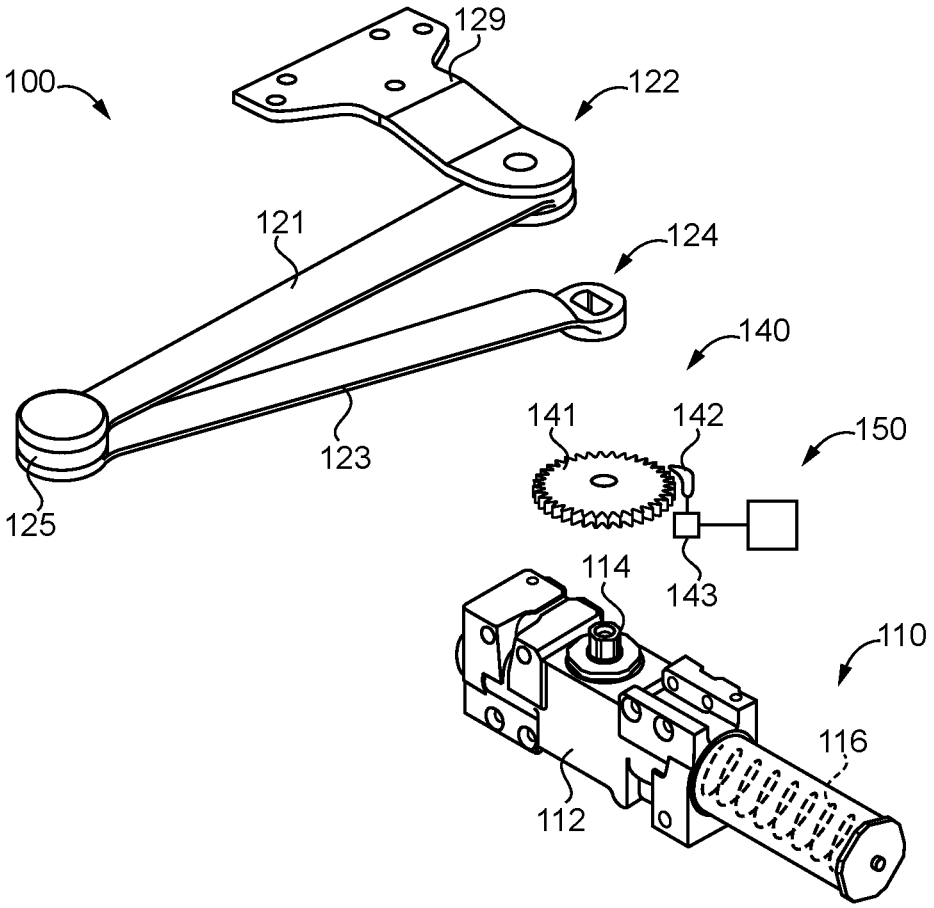
FIG. 2 is an exploded assembly view of the door closer illustrated in FIG. 1.

With additional reference to FIG. 2, the door closer 100 generally includes a body portion 110 configured for mounting to one of the doorframe 82 or the door 84, and an armature 120 connected to the body portion 110 and configured for coupling to the other of the doorframe 82 or the door 84, and may further include a decorative case 130 (FIG. 1) that covers the body portion 110. In the illustrated form, the body portion 110 is mounted to the door 84, and the armature 120 is pivotally coupled to the doorframe 82. In other embodiments, the body portion 110 may be mounted to the doorframe 82, and the armature 120 may be pivotally coupled to the door 84. As described herein, the door closer 100 further includes a hold-open assembly 140 that selectively retains the door 84 in an open position, and a control assembly 150 that controls operation of the hold-open assembly 140.

The body portion 110 generally includes a housing 112 and a pinion 114 rotatably mounted to the housing 112 for rotation in a closing direction and an opening direction. In the illustrated form, the body portion 110 further includes a spring 116 that is housed in the housing 112, and which biases the pinion 114 in the closing direction. In certain forms, the spring 116 may engage a rack member that engages a gear of the pinion 114 such that the pinion 114 is biased in the closing direction. In certain embodiments, the body portion 110 may be the body portion of a hydraulic door closer, for example of the type described in U.S. Pat. No. 4,378,612, the contents of which are incorporated by reference in their entirety. It is also contemplated that the body portion 110 may be an electrified door closer including a motor.

The armature 120 includes a first end portion 122 configured for pivotal connection to the closure assembly 80 (e.g., via a mounting bracket 129), and a second end portion 124 that is rotationally coupled with the pinion 114. In the illustrated form, the armature 120 includes a first arm 121 including the first end portion 122, a second arm 123 including the second end portion 124, and a hinge 125 that pivotably connects the first arm 121 and the second arm 123. In other embodiments, the first end portion 122 and the second end portion 124 may be formed on a single arm. In such forms, the first end portion 122 may be coupled to the closure assembly 80 via a sliding pivot that travels linearly within a track.

The hold-open assembly 140 generally includes a ratchet wheel 141, a pawl 142 selectively engaged with the ratchet wheel 141, and a driver 143 operable to move the pawl 142 out of engagement with the ratchet wheel 141. The ratchet wheel 141 is rotationally coupled with the pinion 114 such that the pinion 114 and the ratchet wheel 141 are coupled for joint rotation in the closing direction and the opening direction. The pawl 142 has an engaged position and a disengaged position, and is biased toward the engaged position. As described herein, the driver 143 is configured to move the pawl 142 between the engaged position and the disengaged position based upon commands received from the control system 150.

The hold-open assembly 140 has a holding state in which the pawl 142 is in the engaged position. In the engaged position, the pawl 142 permits rotation of the ratchet wheel 141 in the opening direction and prevents rotation of the ratchet wheel 141 in the closing direction, thereby permitting opening movement of the door 84 while preventing closing movement of the door 84. The hold-open assembly 140 also has a releasing state in which the pawl 142 is in its disengaged position. In the disengaged position, the pawl 142 permits rotation of the ratchet wheel 141 in both the opening direction and the closing direction, thereby permitting both opening movement and closing movement of the door 84. Exemplary forms of the hold-open assembly 140 are provided below with reference to FIGS. 4-7.

Figure 3:
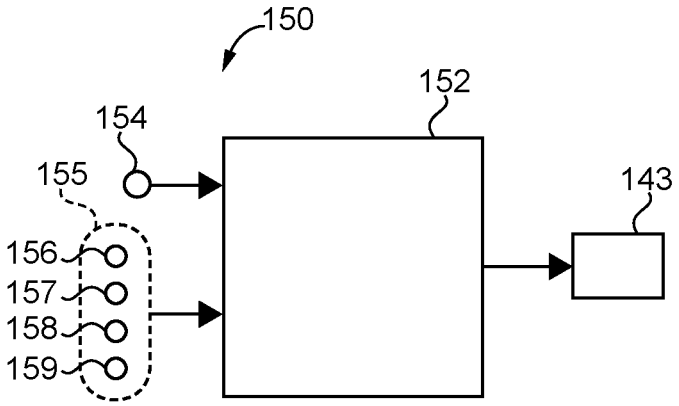
FIG. 3 is a schematic block diagram of a control assembly according to certain embodiments.

With additional reference to FIG. 3, the control assembly 150 includes a controller 152, a power supply 154, and at least one input device 155. The at least one input device 155 may include one or more of a microphone 156, a smoke detector 157, a power supply sensor 158, and/or a wireless communication device 159. In the illustrated form, the power supply 154 is an onboard power supply, and may include one or more batteries and/or super-capacitors. In other embodiments, the power supply 154 may be line power. As described herein, the controller 152 is configured to transmit actuating signals to the driver 143 based upon information received from the at least one input device 155.

Operation of the closure assembly 80 may begin with the door 84 in a closed position relative to the doorframe 82. From the closed position, the door 84 may be moved to an open position, during which motion the pinion 114 rotates in the opening direction against the biasing force of the spring 116. In certain embodiments, the door 84 may be moved to the open position by a user manually applying force to the door 84. In such forms, rotation of the pinion 114 may compress the spring 116, thereby storing mechanical energy that can subsequently be used to drive the door 84 to the closed position. Additionally or alternatively, manual actuation of the door 84 may cause a motor of the door closer 100 to act as a generator, thereby generating electrical energy that can be stored and subsequently released to cause the motor to drive the pinion 114 in the closing direction.

With the door 84 in the open position, the spring 116 may exert a biasing force urging the pinion 114 in the closing direction. As described herein, this biasing force is selectively counteracted by a holding force exerted by the hold-open assembly 140 when the hold-open assembly 140 is in the holding state. The holding force prevents rotation of the second end portion 124 of the armature 120, thereby retaining the door 84 in the open position. When the hold-open assembly transitions to the releasing state, the holding force is removed. As a result, the biasing force of the spring 116 drives the pinion 114 to rotate in the closing direction, thereby causing rotation of the second end portion 124 of the armature 120, thereby causing a corresponding closing motion of the door 84.

As noted above, operation of the hold-open assembly 140 is controlled by the control assembly 150. More particularly, the controller 152 is operable to transmit actuating signals to the driver 143 such that the driver 143 moves the hold-open assembly 140 between the holding state and the releasing state. In the illustrated form, the controller 152 normally causes the driver 143 to maintain the hold-open assembly 140 in the holding state. The controller 152 is also configured to determine a release condition based upon information received from the at least one input device 155, and to transmit a release signal to the driver 143 in response to the release condition. The release signal is one that causes the driver 143 to transition the hold-open assembly 140 to the release state using power drawn from the power supply 154.

In certain embodiments, an input device 155 may be provided in the form of a microphone 156, and the controller 152 may transmit the release signal based upon information received from the microphone 156. As one example, the controller 152 may be configured to detect the sound of an alarm such as a fire alarm or an external smoke alarm, and to transmit the release signal in response to detecting the sound of the alarm. The controller 152 may be configured to distinguish between such alarms and other sounds based upon algorithms stored in memory accessible to the controller 152. Such algorithms may, for example, cause the controller to compare detected sounds to one or more predetermined alarm profiles, and to determine the release condition in response to the detected sounds matching the one or more of the predetermined alarm profiles. For example, many fire alarm systems generate three alarm pulse tones in rapid succession, where each pulse includes a first tone falling within a first predetermined frequency range and/or a second tone falling within a second predetermined frequency range. The controller 152 may be structured to recognize such alarm tones based upon the simultaneous presence of frequencies within the first and/or second frequency range, the duration of the pulses, and/or the periodicity of the pulses. In certain forms, the controller 152 may be configured to utilize techniques such as those described in U.S. Pat. No. 9,536,400 to Asada, the contents of which are incorporated by reference in their entirety.

In certain embodiments, an input device 155 may be provided in the form of a smoke detector 157, and the controller 152 may transmit the release signal based upon information received from the smoke detector 157. In such forms, the controller 152 may be configured to determine the release condition when smoke is detected by the smoke detector 157, and to transmit the release signal based upon determining the release condition.

In certain embodiments, an input device 155 may be provided in the form of a power supply sensor 158, and the controller 152 may transmit the release signal based upon information received from the power supply sensor 158. For example, the power supply sensor 158 may be a voltage sensor configured to sense a voltage of the power supply 154, and the controller 152 may be configured to transmit the release signal in response to the sensed voltage falling below a threshold voltage. Where the power supply 154 includes an onboard power supply, the threshold voltage may be a safety threshold voltage greater than a failure threshold voltage.

The safety threshold voltage may be correlated with a safety threshold charge of the onboard power supply 154, and the failure threshold voltage may be correlated with a failure threshold charge of the onboard power supply 154. The safety threshold charge of the power supply is a charge sufficient to actuate the driver 143 with a predetermined factor of safety, whereas the failure threshold charge is one below which the remaining charge in the power supply 154 will be insufficient to actuate the driver 143. By actuating the driver 143 in response to the voltage falling below the safety threshold voltage and prior to the charge falling below the failure threshold charge, one can ensure that the hold-open device 140 returns to the releasing state when the onboard power supply is failing, but prior to a complete failure thereof.

In certain embodiments, an input device 155 may be provided in the form of a wireless communication device 159, and the controller 152 may transmit the release signal based upon information received from the wireless communication device 159. For example, the controller 152 may be in communication with an access control system, an alarm system, or a mobile device via the wireless communication device 159, and may transmit the release signal based upon commands received from the access control system or the alarm system. Such commands may, for example, be issued by the access control system or the alarm system based upon a fire condition having been detected in the vicinity of the closure assembly 80. Additionally or alternatively, such commands may be issued by the mobile device, for example during testing and calibration of the hold-open assembly.

Figure 4:
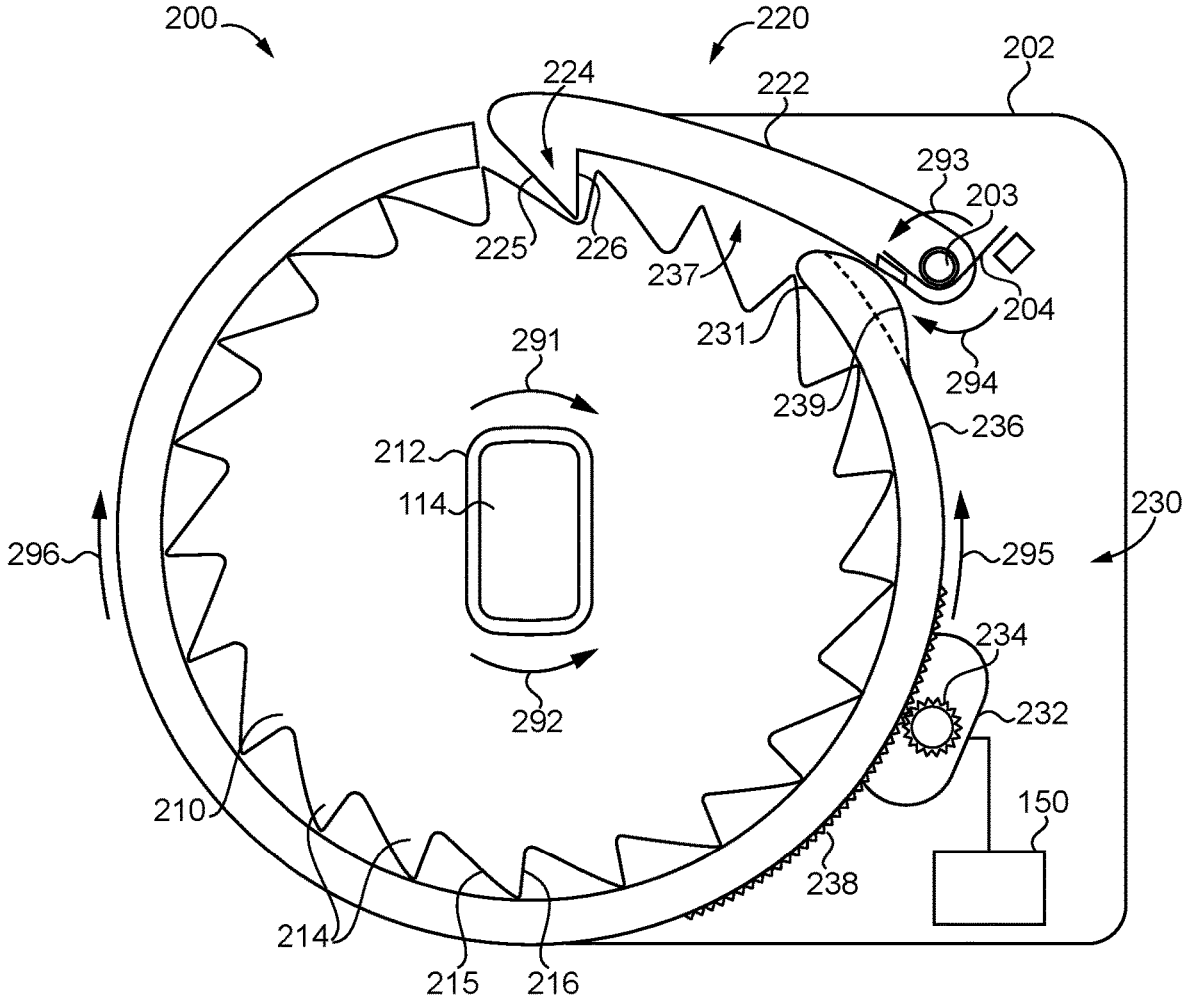
FIG. 4 is a schematic plan view of a hold-open assembly according to certain embodiments in a holding state.

With additional reference to FIG. 4, illustrated therein is a hold-open assembly 200 according to certain embodiments, which is one implementation of the hold-open assembly 140. In the illustrated form, the hold-open assembly 200 includes a ratchet wheel 210, a pawl 220, and a driver 230, which respectively correspond to the ratchet wheel 141, the pawl 142, and the driver 143. In certain forms, the hold-open assembly 200 may be mounted to the decorative case 130, while in other embodiments the hold-open assembly 200 may be mounted to the body portion 110. For example, a baseplate 202 of the hold-open assembly 200 may be configured for coupling to case 130 or the body portion 110, such as via adhesive and/or fasteners. Alternatively, the baseplate 202 may be configured for mounting to the closure assembly 80. For example, in embodiments in which the body portion 110 is mounted to the door 84, the baseplate 202 may likewise be configured for mounting to the door 84.

The ratchet wheel 210 includes a central opening 212 sized and shaped to matingly engage the pinion 114. The pinion 114 extends through the ratchet wheel 210 and engages the second end portion 124 of the armature 120 such that the pinion 114, the ratchet wheel 210, and the second end portion 124 are rotationally coupled with one another. Thus, the pinion 114 and the ratchet wheel 210 are coupled for joint rotation in the opening direction 291 and the closing direction 292. The outer periphery of the ratchet wheel 210 includes a plurality of ratchet teeth 214, each of which includes a ramp 215 and a shoulder 216. During rotation of the ratchet wheel 210 in the opening direction 291, the ramps 215 define leading edges of the teeth 214 and the shoulders 216 define trailing edges of the teeth 214. During rotation of the ratchet wheel 210 in the closing direction, by contrast, the shoulders 216 define leading edges of the teeth 214 and the ramps 215 define trailing edges of the teeth 214.

The pawl 220 is mounted to the baseplate 202 for movement in an engaging direction 293 and an opposite disengaging direction 294, and is biased in the engaging direction 293. For example, the pawl 220 may be pivotably mounted to the baseplate 202 at a pivot boss 203, and a spring 204 may be engaged with the baseplate 202 and the pawl 220 such that the spring 204 urges the pawl 220 in the engaging direction. While the illustrated spring 204 is provided in the form of a torsion spring, it is also contemplated that the spring 204 may be provided as a compression spring, and extension spring, a leaf spring, or another form of biasing member. The illustrated pawl 220 includes a body portion 222 into which the pivot boss 203 extends, and a pawl tooth 224 having a ramp 215 and a shoulder 216. While the illustrated pawl 220 is structured to pivot between its engaged and disengaged positions, it is also contemplated that the pawl 220 may instead be linearly driven between its engaged and disengaged positions.

The pawl 220 has an engaged position in which the pawl tooth 224 is engaged with one or more of the ratchet teeth 214, and a disengaged position (FIG. 5) in which the pawl tooth 224 is disengaged from the ratchet teeth 214. When the pawl 220 is in the engaged position and the ratchet wheel 210 is rotated in the opening direction 291, the ramps 215, 225 engage one another and urge the pawl 220 toward the disengaged position against the biasing force of the spring 204. As the ratchet wheel tooth 214 passes the pawl tooth 224, the spring 204 drives the pawl 220 in the engaging direction 293, and the process repeats.

When the door 84 is no longer being driven toward the open position, the pinion 114 and the ratchet wheel 210 are urged to rotate in the closing direction 292, for example by the spring 116. As the ratchet wheel 210 attempts to rotate in the closing direction 292, the shoulders 216, 226 engage one another such that the pawl 220 prevents rotation of the ratchet wheel 210 and the pinion 114 in the closing direction, thereby maintaining the door 84 in the open position. Thus, when the pawl 220 is in the engaged position, the pawl 220 permits rotation of the ratchet wheel 210 in the opening direction 291 and prevents rotation of the ratchet wheel 210 in the closing direction 292.

The driver 230 is operable to move the pawl 220 between the engaged position and the disengaged position, and in the illustrated form includes a rotary motor 232 that is drivingly connected to a drive gear 234, and a slip ring 236 engaged with the drive gear 234 such that the motor 232 is operable to drive the slip ring 236 in an unlocking direction 295 and an opposite locking direction 296. The slip ring 236 is mounted about the ratchet wheel 210, and includes an opening 237 through which the pawl 220 extends to engage the ratchet wheel 210. In the illustrated form, at least a portion of the outer periphery of the slip ring 236 includes gear teeth 238 that mesh with the teeth of the drive gear 234, thereby facilitating rotation of the slip ring 236 by the motor 232.

In FIG. 4, the hold-open assembly 200 is illustrated in a holding state. In this state, the slip ring 236 is in a locking position, and the pawl 220 is in the engaged position. More particularly, the slip ring opening 237 is positioned such that the pawl 220 extends through the opening 237 and engages the ratchet wheel teeth 214. Thus, when the slip ring 236 is in the locking position, the pawl 220 is in the engaged position and locks the ratchet wheel 210 against rotation in the closing direction 292.

Figure 5:
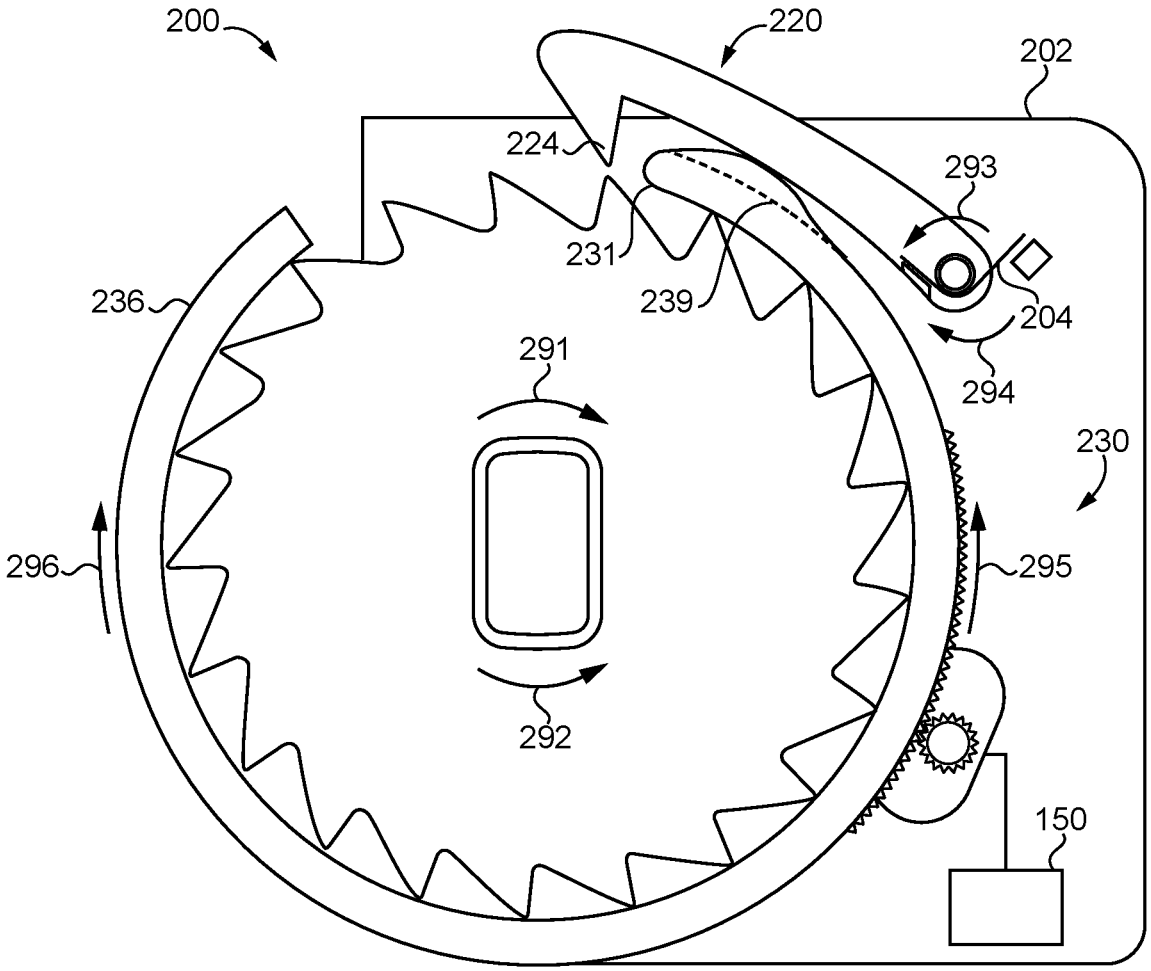
FIG. 5 is a schematic plan view of the hold-open assembly illustrated in FIG. 4 while in a releasing state.

With additional reference to FIG. 5, the hold-open assembly 200 also has a releasing state. As described in further detail below, the control assembly 150 is operable to actuate the motor 232 such that the motor 232 drives the slip ring 236 in the unlocking direction 295 and toward the unlocking position illustrated in FIG. 5. As the slip ring 236 rotates in the unlocking direction, a leading portion 231 of the slip ring 236 engages the pawl 220 and pivots the pawl 220 in the disengaging direction 294 against the biasing force of the spring 204. The leading portion 231 of the slip ring 236 may include a lobe 239 that facilitates such pivoting of the pawl 220. As the pawl 220 moves to the disengaged position, the ratchet wheel 210 becomes free to rotate in the closing direction 292. Thus, with the hold-open assembly 200 in the releasing state, the door closer 100 is able to prevent movement of the door in its closing direction.

From the releasing state (FIG. 5), the hold-open assembly 200 can be returned to the holding state (FIG. 4) by actuating the motor 232 to drive the slip ring in the locking direction 296. As the slip ring 236 returns to its locking position, the spring 204 drives the pawl 220 to its engaged position, thereby returning the hold-open assembly 200 to the holding state, in which the hold-open assembly 200 is once again operable to retain the door 84 in its open position.

In the illustrated form, the slip ring 236 is driven between the locking position and the unlocking position by the motor 232, which interfaces with the slip ring 236 via the gear 234 and the teeth 238. It is also contemplated that the slip ring 236 may be driven between its locking and unlocking positions in another manner. As one example, the motor 232 may be replaced by a rotary solenoid. As another example, the slip ring 236 may include a radial arm, and the motor 232 may be replaced by a linear actuator that engages the radial arm to drive the slip ring 236 between its locking and unlocking positions. In further embodiments, the slip ring 236 may be omitted, and the pawl 220 may be driven between its engaging and disengaging positions in another manner. An example of a hold-open assembly along these lines is illustrated in FIGS. 6 and 7.

Figure 7:
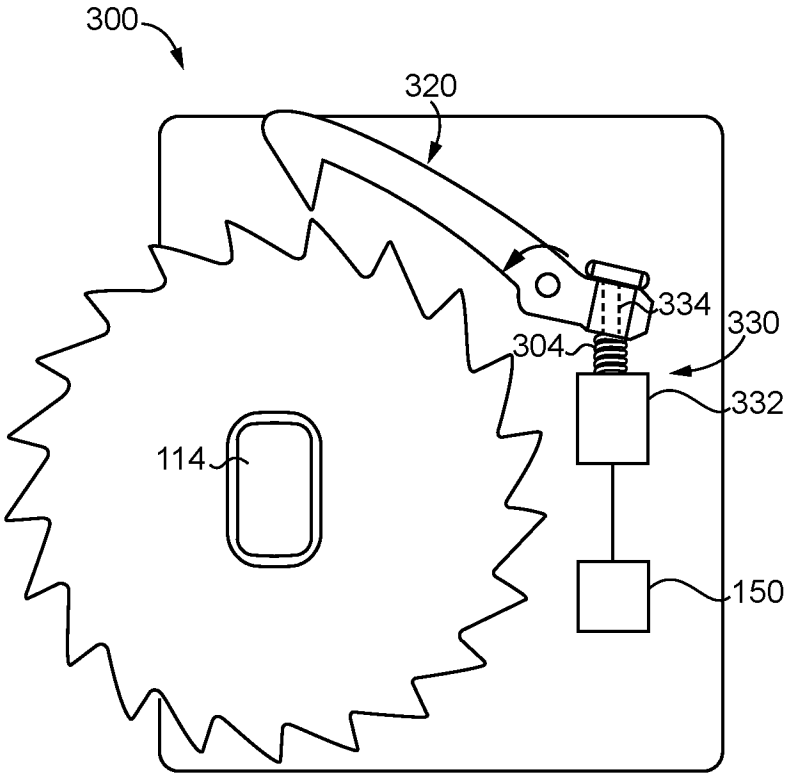
FIG. 7 is a schematic plan view of the hold-open assembly illustrated in FIG. 6 while in a releasing state.
Figure 6:
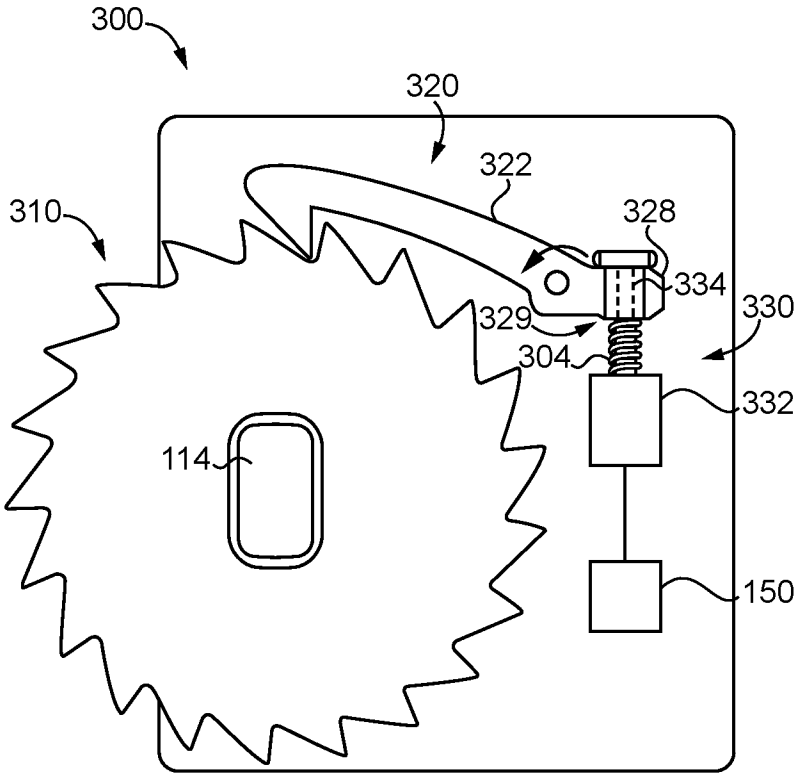
FIG. 6 is a schematic plan view of a hold-open module according to certain embodiments in a holding state.

With reference to FIGS. 6 and 7, illustrated therein is a hold-open assembly 300 according to certain embodiments. The hold-open assembly 300 is similar to the above-described hold-open assembly 200, and similar reference characters are used to indicate similar elements and features. For example, the hold-open assembly 300 includes a ratchet wheel 310, a pawl 320, and a driver 330, which respectively correspond to the ratchet wheel 210, the pawl 220, and the driver 230. In the interest of conciseness, the following description regarding the hold-open assembly 300 focuses primarily on features that are different from those described above with regard to the hold-open assembly 200.

In the current embodiment, the driver 330 does not include a slip ring such as the slip ring 236. Instead, the pawl 320 includes a second arm 328, which in the illustrated form is positioned on an opposite side of the pivot boss 304 as the first arm 322. The driver 330 is provided in the form of a linear actuator, and includes a motor 332 and a reciprocating plunger 334 that extends through an opening 329 in the second arm 328. A compression spring 304 is mounted to the plunger 334 and biases the pawl 320 toward the engaged position. Upon receiving the release signal from the controller 152, the motor 332 retracts the plunger 334 such that the plunger 334 drives the pawl 320 to the disengaged position against the force of the spring 304. As will be appreciated, the controller 152 may transmit the release signal based upon any of the above-described criteria, or based upon other criteria not specifically described herein. Furthermore, while the illustrated driver 330 is provided as a linear actuator including a motor 332, it is also contemplated that the driver 330 may be provided in another form. For example, the motor 332 may be replaced with a solenoid core to provide a linear actuator in the form of a solenoid.

Figure 8:
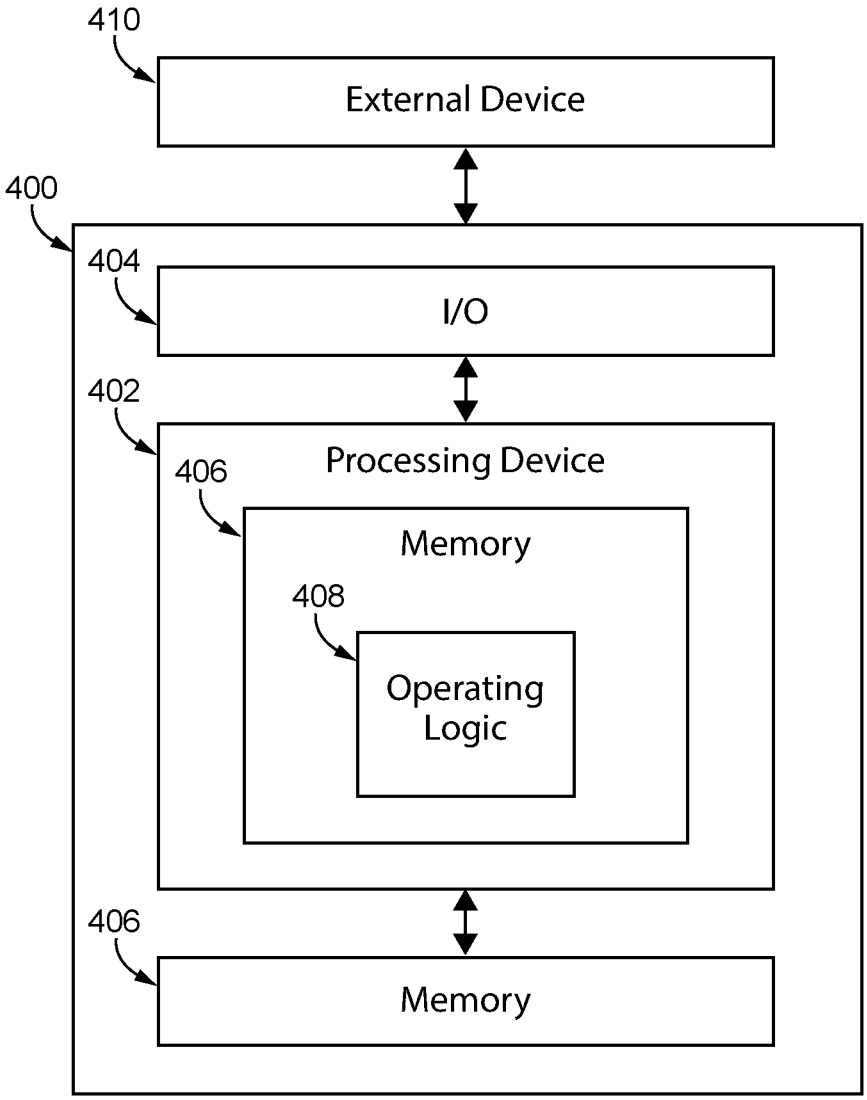
FIG. 8 is a schematic block diagram of a computing device according to certain embodiments.

FIG. 8 is a schematic block diagram of a computing device 400. The computing device 400 is one example of a computer, server, mobile device, reader device, or equipment configuration which may be utilized in connection with the control system 150 shown in FIG. 3. The computing device 400 includes a processing device 402, an input/output device 404, memory 406, and operating logic 408. Furthermore, the computing device 400 communicates with one or more external devices 410.

The input/output device 404 allows the computing device 400 to communicate with the external device 410. For example, the input/output device 404 may be a network adapter, network card, interface, or a port (e.g., a USB port, serial port, parallel port, an analog port, a digital port, VGA, DVI, HDMI, FireWire, CAT 5, or any other type of port or interface). The input/output device 404 may be comprised of hardware, software, and/or firmware. It is contemplated that the input/output device 404 includes more than one of these adapters, cards, or ports.

The external device 410 may be any type of device that allows data to be inputted or outputted from the computing device 400. For example, the external device 410 may be a mobile device, a reader device, equipment, a handheld computer, a diagnostic tool, a controller, a computer, a server, a printer, a display, an alarm, an illuminated indicator such as a status indicator, a keyboard, a mouse, or a touch screen display. Furthermore, it is contemplated that the external device 410 may be integrated into the computing device 400. It is further contemplated that there may be more than one external device in communication with the computing device 400.

The processing device 402 can be of a programmable type, a dedicated, hardwired state machine, or a combination of these; and can further include multiple processors, Arithmetic-Logic Units (ALUs), Central Processing Units (CPUs), Digital Signal Processors (DSPs) or the like. For forms of processing device 402 with multiple processing units, distributed, pipelined, and/or parallel processing can be utilized as appropriate. The processing device 402 may be dedicated to performance of just the operations described herein or may be utilized in one or more additional applications. In the depicted form, the processing device 402 is of a programmable variety that executes algorithms and processes data in accordance with operating logic 408 as defined by programming instructions (such as software or firmware) stored in memory 406. Alternatively or additionally, the operating logic 408 for the processing device 402 is at least partially defined by hardwired logic or other hardware. The processing device 402 can be comprised of one or more components of any type suitable to process the signals received from input/output device 404 or elsewhere, and provide desired output signals. Such components may include digital circuitry, analog circuitry, or a combination of both.

The memory 406 may be of one or more types, such as a solid-state variety, electromagnetic variety, optical variety, or a combination of these forms. Furthermore, the memory 406 can be volatile, nonvolatile, or a combination of these types, and some or all of memory 406 can be of a portable variety, such as a disk, tape, memory stick, cartridge, or the like. In addition, the memory 406 can store data that is manipulated by the operating logic 408 of the processing device 402, such as data representative of signals received from and/or sent to the input/output device 404 in addition to or in lieu of storing programming instructions defining the operating logic 408, just to name one example. As shown in FIG. 7, the memory 406 may be included with the processing device 402 and/or coupled to the processing device 402.

The processes in the present application may be implemented in the operating logic 408 as operations by software, hardware, artificial intelligence, fuzzy logic, or any combination thereof, or at least partially performed by a user or operator. In certain embodiments, units represent software elements as a computer program encoded on a non-transitory computer readable medium, wherein the controller 152 performs the described operations when executing the computer program.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door closer configured for use with a doorframe and a door movably mounted to the doorframe, the door closer comprising:

a body portion configured for mounting to one of the doorframe and the door;

a pinion rotatably mounted to the body portion, wherein the pinion is operable to rotate in a closing direction and an opening direction opposite the closing direction;

an armature having a first end portion and an opposite second end portion, wherein the first end portion is configured to be pivotably coupled to the other of the door and the doorframe, and wherein the second end portion is coupled to the pinion for joint rotation therewith;

a ratchet wheel mounted to the pinion such that the pinion and the ratchet wheel are coupled for joint rotation in the closing direction and the opening direction;

a pawl selectively engaged with the ratchet wheel, the pawl having an engaged position in which the pawl permits rotation of the ratchet wheel in the opening direction and prevents rotation of the ratchet wheel in the closing direction, the pawl having a disengaged position in which the pawl permits rotation of the ratchet wheel in both the opening direction and the closing direction;

a driver operable to move the pawl between the engaged position and the disengaged position, wherein the driver comprises a slip ring having a locking position in which the slip ring permits the pawl to remain in the engaged position and an unlocking position in which the slip ring maintains the pawl in the disengaged position; and a controller in communication with the driver and operable to cause the driver to move the pawl between the engaged position and the disengaged position.

2. The door closer of claim 1, wherein the driver comprises an electromechanical actuator; and wherein the door closer further comprises an onboard power supply operable to supply electrical power to the electromechanical actuator and to the controller.

3. The door closer of claim 2, wherein the controller is configured to transmit a release signal to the electromechanical actuator in response to determining a release condition; and wherein the driver is configured to move the pawl from the engaged position to the disengaged position in response to the release signal.

4. The door closer of claim 3, further comprising at least one input device in communication with the controller; and wherein the controller is configured to determine the release condition based upon information received from the at least one input device.

5. The door closer of claim 4, wherein the at least one input device comprises power level sensor monitoring a power level of the onboard power supply; and wherein the controller is configured to transmit the release signal in response to the power level of the onboard power supply falling below a predetermined threshold.

6. The door closer of claim 5, wherein the predetermined threshold is a safety threshold at which remaining power in the onboard power supply is sufficient to actuate the driver to drive the pawl from the engaged position to the disengaged position with a factor of safety;

wherein the safety threshold is greater than a failure threshold below which the remaining power in the onboard power supply is insufficient to actuate the driver to drive the pawl from the engaged position to the disengaged position; and wherein the controller is configured to determine the release condition in response to the power level of the onboard power supply being between the safety threshold and the failure threshold.

7. The door closer of claim 4, wherein the at least one input device comprises a microphone.

8. The door closer of claim 7, wherein the controller is configured to determine the release condition in response to determining that the information received from the microphone is indicative of an audible alarm sounding.

9. The door closer of claim 8, wherein the controller is configured to determine that the information received from the microphone is indicative of an audible alarm sounding based upon at least one of (i) a frequency of detected sound, (ii) a duration of detected sound, or (iii) a periodicity of detected sound.

10. The door closer of claim 4, wherein the at least one input device comprises a wireless communication device; and wherein the controller is configured to determine the release condition in response to receiving a release command via the wireless communication device.

11. The door closer of claim 4, wherein the at least one input device comprises a smoke detector; and wherein the controller is configured to determine the release condition in response to detecting smoke via the smoke detector.

12. The door closer of claim 1, wherein the pinion is biased in the closing direction and the pawl is biased toward the engaged position.

13. A closure assembly including the door closer of claim 1, the closure assembly further comprising a doorframe and a door;

wherein the body portion is mounted to the one of the doorframe and the door;

wherein the second end portion of the armature is pivotably coupled to the other of the doorframe and the door;

wherein closing movement of the door is correlated with rotation of the pinion in the closing direction; and wherein opening movement of the door is correlated with rotation of the pinion in the opening direction.

14. A method of operating the closure assembly of claim 13, wherein the door closer further comprises at least one input device in communication with the controller, and wherein the method comprises:

selectively maintaining the pawl in the engaged position, thereby preventing closing movement of the door;

determining, by the controller, a release condition based upon information received from the at least one input device;

transmitting, by the controller, a release signal to the driver in response to determining the release condition; and moving, by the driver, the pawl from the engaged position to the disengaged position, thereby permitting closing movement of the door.

15. The door closer of claim 1, wherein the driver comprises an electromechanical actuator;

wherein the controller is operable to determine a release condition of the driver and to transmit a release signal to the driver in response to determining the release condition to move the pawl from the engaged position to the disengaged position; and wherein the door closer further comprises:

an onboard power supply operable to supply electrical power to the controller and to the electromechanical actuator;

a power supply sensor sensing a power level of the power supply, wherein the controller is configured to determine a release condition of the driver in response to the power level falling below a predetermined threshold power level; and a microphone configured to detect sounds, wherein the controller is configured to determine the release condition in response to a detected sound matching an alarm profile.

16. The door closer of claim 15, wherein the driver comprises a rotary motor.

17. The door closer of claim 16, wherein the rotary motor is configured to rotate the slip ring between the locking position and the unlocking position.

18. The door closer of claim 17, wherein the driver further comprises a drive gear driven by the rotary motor; and wherein an outer periphery of the slip ring includes gear teeth meshed with teeth of the drive gear.

19. The door closer of claim 15, further comprising a spring biasing the pawl toward the engaged position.

20. A door closer configured for use with a doorframe and a door movably mounted to the doorframe, the door closer comprising:

a body portion configured for mounting to one of the doorframe and the door;

a pinion rotatably mounted to the body portion and operable to rotate in a closing direction and an opening direction;

a ratchet wheel mounted to the pinion for joint rotation therewith in the closing direction and the opening direction;

a pawl selectively engaged with the ratchet wheel, the pawl having an engaged position in which the pawl is engaged with the ratchet wheel and a disengaged position in which the pawl is disengaged from the ratchet wheel, wherein the pawl in the engaged position permits rotation of the ratchet wheel in the opening direction and prevents rotation of the ratchet wheel in the closing direction, and wherein the pawl in the disengaged position permits rotation of the ratchet wheel in both the opening direction and the closing direction;

an electromechanical driver operable to move the pawl between the engaged position and the disengaged position, wherein the electromechanical driver comprises a slip ring having a locking position in which the slip ring permits the pawl to remain in the engaged position and an unlocking position in which the slip ring maintains the pawl in the disengaged position; and a controller in communication with the electromechanical driver and operable to cause the driver to move the pawl between the engaged position and the disengaged position.

21. The door closer of claim 20, wherein the controller is operable to determine a release condition and to transmit a release signal to the electromechanical driver to move the pawl from the engaged position to the disengaged position.

22. The door closer of claim 21, wherein the door closer further comprises an onboard power supply operable to supply electrical power to the electromechanical driver and to the controller;

wherein the door closer further comprises a power supply sensor sensing a power level of the onboard power supply; and wherein the controller determines the release condition in response to the sensed power level falling below a predetermined threshold power level.

23. The door closer of claim 21, wherein the door closer further comprises an onboard power supply operable to supply electrical power to the electromechanical driver and to the controller;

wherein the door closer further comprises a microphone configured to detect sounds; and wherein the controller is configured to determine the release condition in response to a detected sound matching an alarm profile.

24. The door closer of claim 20, further comprising an armature having a first end portion and an opposite second end portion, wherein the first end portion is configured to be pivotably coupled to the other of the door and the doorframe, and wherein the second end portion is coupled to the pinion for joint rotation therewith.

25. The door closer of claim 20, wherein the driver comprises a rotary motor configured to rotate the slip ring between the locking position and the unlocking position.

* * * * *